United States Patent [19]

Chapman

[11] Patent Number: 4,794,824

[45] Date of Patent: Jan. 3, 1989

[54] ADJUSTABLE VICE-LOCKING END WRENCH

[76] Inventor: William C. Chapman, 26451 Anchorage La., P.O. Box 402, Helendale, Calif. 92342

[21] Appl. No.: 58,860

[22] Filed: Jun. 5, 1987

[51] Int. Cl.[4] ..... B25B 13/16

[52] U.S. Cl. ..... 81/165; 81/315; 81/362; 81/131

[58] Field of Search ..... 81/362, 315, 131, 166, 81/173, 165

[56] References Cited

U.S. PATENT DOCUMENTS

| | | | |
|---|---|---|---|
| 2,156,529 | 5/1939 | Day | 81/315 |
| 3,190,154 | 6/1965 | Chapman | 81/315 |
| 3,333,492 | 8/1967 | Chapman | 81/362 |
| 4,375,174 | 3/1983 | Shanley, Jr. | 81/362 |

FOREIGN PATENT DOCUMENTS

| | | | |
|---|---|---|---|
| 1108967 | 10/1954 | France | 81/362 |

*Primary Examiner*—James G. Smith
*Assistant Examiner*—Blynn Shideler
*Attorney, Agent, or Firm*—Herzig & Yanny

[57] ABSTRACT

An improved and simplified vice-locking adjustable end wrench with a primary handle whose jaws are manually adjustable by a customary knurled worm gear for initial adjustment, and a simple, single clamping and gripping pivotal handle relative to the usual handle and secured at one end at the jaws and freely extending to the end of the handle to achieve a vice-like gripping action with maximum desired mechanical advantage and force when the handles are forced together to an adjustable extent in a nested relationship so that the clamping handle can effectively carry the initial wrench closing forces.

6 Claims, 1 Drawing Sheet

FIG. 1.
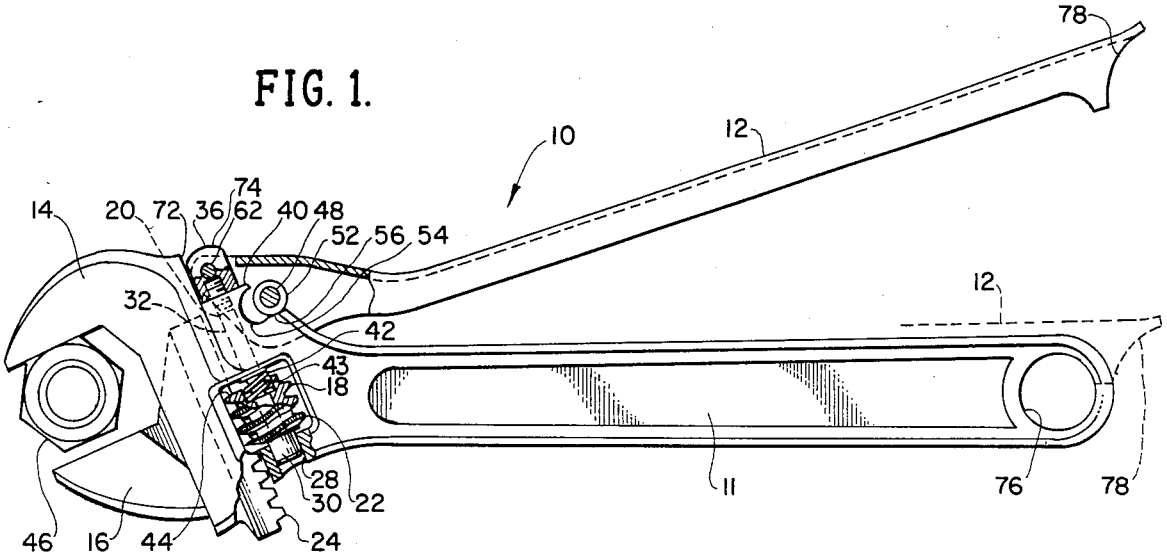
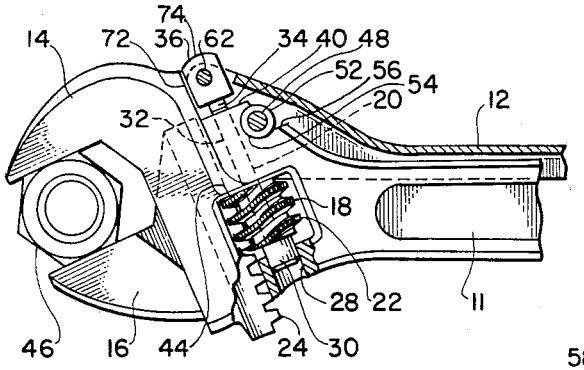
FIG. 2.
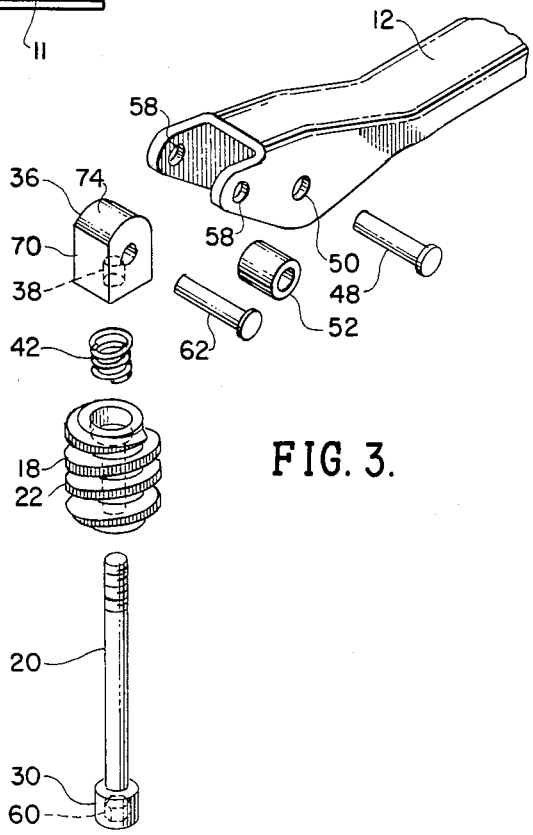
FIG. 3.

ADJUSTABLE VICE-LOCKING END WRENCH

BACKGROUND OF THE INVENTION

1. Field of the Invention

This invention relates to hand tools and, particularly, to adjustable end wrenches with means for effecting gross initial adjustment, and vice-locking means therefor to lock the jaws in position on and around a workpiece. In a preferred embodiment, the invention is disclosed as applied to a crescent-type adjustable wrench with improved simplified operation and construction.

2. Prior Art

The closest prior art known to applicant is that set forth in his prior patents, U.S. Pat. No. 3,190,154 issued June 22, 1965 for Adjustable End Wrench With Locking Means, and U.S. Pat. No. 3,333,492 similarly entitled and issued Aug. 1, 1967. Said prior patents disclose a wrench intended for the same purpose and providing more complex linkages for accomplishing a gripping of the workpiece under pressure with vice-like force. The instant invention accomplishes the same result in a more effective manner by more effectively, more simply and more economically positioning the clamping lever above and as part of the handle and operational therewith by the same turning movement as is utilized in turning the wrench handle in its normal and intended engagement with a workpiece as, for example, in turning a nut on a bolt, or, with suitably surfaced gripping jaws turning the smooth round bolt itself—in a manner of use heretofore reserved for conventional pipe wrenches or their like.

The number of parts are reduced and their shape and construction are simplified to eliminate complex linkages. Thus, simplified and economic manufacture results, and ease of use is also achieved.

Natural operation of the instant wrench corresponds to a wrench having a single handle. Its two-part handle automatically adjusts for increasing wrenching power. The gripping force becomes increasingly strong as the lever handle half is forced into its automatic gripping mode as required by the resistance of the workpiece. The full length of the single gripping lever acts more naturally and with improved leverage and mechanical advantage. It is to be noted that all of the known prior art calls for an initial hand-squeezing action around both the lever handle and the primary handle before the ultimate vice gripping is fully effective. The instant wrench can accomplish its gripping action, as well as its turning action, simultaneously because rotating and gripping action of the wrench are both transmitted through the lever which functions as a conventional handle to take up slack, and then when further pushed or pulled against the primary handle, the lever acts as a clamp handle, thus causing gripping of the jaws.

OBJECTS AND SUMMARY OF THE INVENTION

It is an object of this invention to improve upon adjustable end wrenches and locking means therefor, both in construction and in mode of operation.

It is another object of the invention to provide an adjustable vice-locking end wrench of simplified construction, facile in use and economic in construction—as well as providing an improved wrenching and gripping action.

Another object of the invention is to provide a wrench of the character described of uncomplicated form for more facile and effective utilization of handle length, overall wrench length and improved mechanical advantage.

It is specifically an object of the invention to provide a handle construction and operative vice-locking connections while reversing prior art positions of the gripping handle and the primary handle to achieve an unexpectedly better and easier mode of initial application and final gripping use of the wrench.

Yet another object of the invention is to provide a simplified wrench construction of the character described to facilitate not merely the effective application of initial force, but also to ease release of the jaws after use.

It is among the objects of the invention to provide a wrench of improved strength, safe operation, and clamping adjustable to any desired degree of gripping force on the workpiece and the operating handles, while providing improvements over prior art devices intended to accomplish a similar purpose.

The foregoing objects are more fully expressed in the description and claims which follow.

BRIEF DESCRIPTION OF THE DRAWINGS

FIG. 1 is a side view partially in section of a preferred embodiment of the invention in an initial operative but non-gripping position of the jaws.

FIG. 2 is a fragmentary sectional view similar to FIG. 1, but with the jaws in a fully gripping position and the handles in a fully locked, i.e., closed position.

FIG. 3 is an exploded view of parts of the operative mechanism associated with the vice-locking structure.

DETAILED DESCRIPTION OF A PREFERRED EMBODIMENT

Referring more particularly to the drawings, it is to be understood that in the embodiment herein disclosed, as in Applicant's prior patents, the worm gear rotates freely on a spindle and the spindle gers and jaws are adjustable to initial desired opening or closing positions readied for initiating use of the wrench.

The wrench generally designated as 10, includes a handle portion 11 and an auxiliary handle or clamping lever 12 for inducing gripping pressure between the upper jaw 14 which is unitary with the handle 11, and the lower jaw 16 which is unitary with the clamping lever 12. As exemplified in Applicant's prior U.S. Pat. Nos. 3,190,154 and 3,333,492 previously referred to, a knurled worm gear 18 freely rotates and slides along a coaxial pin 20. The teeth 22 of the worm gear 28 co-act with the teeth 24 on the lower jaw 16 in a manner that will open and close the jaws 14 and 16. The pin 20 extends from a preferred counterbore 28 adapted to receive the head 30 of the pin 20 upwardly through the coaxial bore 32 in the handle and lower jaw of the wrench, and extends upwardly as shown at 34 (FIGS. 1 and 2). The upper end of the pin 20 makes threaded connection in a preferred cap nut 36 and, through said threaded connection at 38 (see FIG. 3), normally holds the cap nut 36 on the face 40 of the upper jaw structure of the handle 11 and upper jaw structure 14.

In the initial clamped open and relatively loose position (FIG. 1) of the jaws, the cap nut 36 abuts against the face 40 under the influence of a coil spring 42 mounted between the jaw body 14 and the upper end of the worm gear 18 normally urging it down.

In the closed and clamped position of the handles 11 and 12 wherein the work, i.e., the nut 46 is firmly gripped (FIG. 2), the spring 42 is compressed and the cap nut 36 is raised from its downmost position as shown in FIG. 1 to its upper position raised above the face 40.

The cap nut 36 is raised by the downward movement of the clamping lever handle 12 relative to the primary handle 11. Said clamping lever handle portion carries a pin 48 fixed in the lever handle at 50, and carries a sleeve 52 which preferably turns on the pin 48 as a cam follower which can be urged against the surface of a cam-shaped recess 54 of appropriate shape as illustrated (FIGS. 1 and 2) to guide the cam follower 52 over the threshold 56 of the cam surface 54 and against said cam surface in a manner to raise the cap nut 36 which is anchored to the pin 62 through the openings 58 in the handle portion 12 (see FIG. 3). By the downward clamping movement of said lever handle 12, the proximal end of the lever handle (i.e., the lefthand end as illustrated) nearest the jaws 14-16 is forced up by said camming action and carried with it, through the pin 20 and its head 30, the knurled gear 18 compressing the spring 42 as aforesaid. The lower jaw 16 is thereby carried upwardly, toward and in cooperation with the upper jaw 14 to any predetermined extent calculated to bear forcibly and with vice-like tenacity against the workpiece 46, and firmly clamping and securing it in the vice-like grip of the jaws. In said latter movement, the jaws move from a relatively loose fit—finger tight if desired—around the work to said tight gripping fit of FIG. 2. The spring 42 may be accommodated in a counterbore 43 at the topside 44 of the worm gear 18 coaxial with and around the pin 20.

In use, the wrench is placed on the work in a customary fashion and tightened to a selected extent, or predetermined extent, such that the movement of the clamping lever relative to the handle will apply the desired gripping pressure to the workpiece 46. Selectively, this may be accomplished by adjusting the work gear 18 to bring the jaws to such proximity or force against the work surface as permits the desired amount of clamping action when the clamping lever is moved towards the handle 11. The degree of gripping force desired can also be achieved on a predetermined basis, that is to say, from a finger-tightened position of the worm gear, whether snugly or loosely, by turning the pin 20 as by means of an Allen wrench recess 60 in the head 30 of the pin to raise or lower the position of the pivot pin 62 around whose axis the clamping lever 12 rotates. The proximal face 70 of the cap nut 36 confronts the back flat face 72 at the back of the upper jaw 14 in an abutting/slidable relationship to prevent its turning and permit the proper function of the cap nut whose upper arcuate end 74 merely contributes to the general aesthetic curvatures of the wrench body.

The threshold 56 of the cam surface 54 may constitute a detent to releasably retain the clamping handle in closed position against the handle portion 11. Said latter handle portion has a finger opening 76 which cooperates with a distal suitably shaped lever tailpiece 78 and assists in manual separation of the clamping lever portion of the handle from the primary handle 11 to relieve and open the jaws 14–16.

The unbroken length of the lever handle 12 provides, as may be seen in FIG. 1, a sufficiently long and adequate lever to give a simple and amply effective gripping action to the jaws, providing an adequate moment of force to achieve as much or as little mechanical advantage and movement as may be desired for the jaws, depending upon the positioning of the cam 54 and the cam follower 52 and the shape and conformation of their abutting surfaces relative to the position of the pivotal axis 62 defined by the pivot pin and sleeve at 62. Thereby, the leveraging lengths can readily be designed and positioned as desired within the teaching of this invention by those skilled in the art.

It will be noted that the positioning of the clamping lever 12 is on the upper side of the wrench and above the handle 11. By this positioning and arrangement of the parts, the user need only turn the wrench about the work in a clockwise direction as illustrated, starting with the parts positioned more or less loosely (FIG. 1). The user's hand will first engage the clamping lever 12 and, without any squeezing of the handle portions 11 and 12 by closed-fist or other such gripping action, the clamping lever will naturally be pulled or pushed and thereby forced toward and against the handle portion 11 until the jaws have initially closed against the work sufficiently to hold to and turn the work most readily (if it has a faceted or irregular shape and cross-section) until the clamping action and gripping action have progressed to the desired extent necessary to turn the work (preferrably in a clockwise direction as shown for a wrench of this character) without forcing the handle portions 11 and 12 together in fully squeezed or closed position, thus facilitating applying the wrench to the work and also facilitating removing it therefrom without the handles being fully closed, and thus further facilitating and easing the speedy use of the wrench on the work and considerably improving and encouraging the use thereof. It is not then necessary to unclamp the jaws at each partial turn of the wrench even though the use of the lever portion, as above noted, utilizes the vice-locking action radially of pin 62 initially to an effective extent, but less than fully closed vice-locking position. The same is not possible, nor is such an advantage to be obtained when the lever portion of the handle is constructed and arranged in reverse position (with the lever handle below the primary handle).

A highly useful and effective wrench embodying utmost simplicity and economy of use and manufacture is disclosed.

The foregoing disclosure is representative of a preferred form of the invention and is to be interpreted in an illustrative rather than a limiting sense. The invention is to be accorded the full scope of the claims which follow.

I claim:

1. In combination in an adjustable end wrench of the character described comprising a first primary handle means and integral first jaw means and a second jaw means disposed below said first jaw means, worm gear means operatively connected to said second jaw means for imparting opening and closing movement to the jaws, pin means for rotatable operative mounting of the worm gear means, operative means for combining said worm gear means with said pin means for limited axial movement to carry with them said second jaw means, and the improvement comprising:

a primary handle means for said wrench having a normally leading lower edge portion and a normally following upper edge portion, the latter for receiving the major wrench-turning load;

an elongate clamping handle means along the following primary load-bearing edge of the primary handle means for initiating gripping movement of the jaws relative to said primary handle means and for initially receiving a wrench-turning load and for turning movement cooperatively therewith, said clamping handle having an end proximate the jaws and distal end;

articulate means for the clamping handle proximate the jaw means to connect the proximate end of the clamping handle to the second jaw means for pulling the second jaws upward into desired gripping and allowing downward movement into releasing engagement upon respective closing and opening movement of the handles relative to one another, said articulate means comprising:

a cam and cam follower positioned in spaced relationship on the proximal end of the clamping handle adjacent to the first jaw means to close the jaws through the initial limited clamping movement accompanying said radial movement of the pin means, and a transverse pin means and means for controlling the distance of gripping movement of the jaws defined by the initial clamping movement of the handles relative to one another; and said operative means includes an abutment on the pin means bearing against the worm gear means; said first named pin means making threaded connection with nut means, said nut means having face-making slidable engagement with the first jaw means for preventing rotation of the nut, and means associated with said pin for moving the worm gear and the lower jaw means for a pre-selected distance defining the initial clamping distance of the gripping distance of the jaws which is less than the fully-closed and fully-opened positions of the primary handle and clamping handle relative to one another.

2. The combination as defined in claim 1 wherein said nut means is pivotally mounted on the clamping handle at said proximate end thereof for pivotally supporting said nut on a horizontal axis to accommodate the movement of the clamping handle in an arcuate path and for providing a turning axis for said clamping handle, said nut means operatively connecting said clamping handle to said first jaw means at a position thereadjacent.

3. The combination as defined in claim 2 wherein said cam means in on the first jaw means confronting said proximal end of said clamping handle and wherein said cam follower includes a rolling sleeve mounted, constructed and arranged to bear against the cam to force the proximate end of the clamping handle in a direction to lift the nut means to accommodate the movement of the second jaw means in a work-gripping direction, and spring means normally urging the first named pin means, worm gear means and nut means in a direction to move the second jaw means in relative open position with respect to the first jaw means.

4. The combination as defined in claim 3 and including detent means for holding the handles in releasable closed position.

5. The combination as defined in claim 4 wherein the clamping handle is unitary and continuous from the proximal portion of the first jaw means to the distal end thereof and having a length at least as great as the primary handle and including, together with said primary handle, extension means and finger-accommodating opening means to facilitate opening movement of the handles from their closed position.

6. The combination as defined in claim 5 wherein said handles are in nested, confronting relationship substantially throughout their length and define uniform, individual, single handles from end to end, respectively.

* * * * *